US005590481A

United States Patent [19]

Vaccari

[11] Patent Number: 5,590,481

[45] Date of Patent: Jan. 7, 1997

[54] SPORT BOOT WITH A FASTENING DEVICE TO LIMIT REARWARD SWING OR FORWARD FLEX

[75] Inventor: Franco Vaccari, Montebelluna, Italy

[73] Assignee: Dolomite S.p.A., Italy

[21] Appl. No.: 645,924

[22] Filed: May 14, 1996

Related U.S. Application Data

[63] Continuation of Ser. No. 303,988, Sep. 9, 1994, abandoned.

[30] Foreign Application Priority Data

Sep. 14, 1993 [EP] European Pat. Off. ..... 93830376

[51] Int. Cl.[6] ..... A43B 5/04

[52] U.S. Cl. ..... 36/118.8; 36/50.5

[58] Field of Search ..... 36/50.5, 117, 121, 36/115, 99, 118.8

[56] References Cited

U.S. PATENT DOCUMENTS

| | | | |
|---|---|---|---|
| 2,444,428 | 7/1948 | Carrier | 36/99 |
| 3,668,791 | 6/1972 | Salzman et al. | 36/117 X |
| 4,104,811 | 8/1978 | Salomon | 36/121 |
| 4,107,856 | 8/1978 | Bourque | 36/50.5 X |
| 4,633,599 | 1/1987 | Morell et al. | 36/50.5 X |
| 4,649,657 | 3/1987 | Iwama . | |
| 4,905,384 | 3/1990 | De Marchi et al. | 36/50.5 X |

FOREIGN PATENT DOCUMENTS

| | | | |
|---|---|---|---|
| 0492116A1 | 7/1992 | European Pat. Off. . | |
| 0073634 | 9/1960 | France | 36/117 |
| 2345960 | 10/1977 | France . | |
| 2417953 | 9/1979 | France . | |
| 3431746A1 | 3/1985 | Germany . | |

*Primary Examiner*—Ted Kavanaugh

*Attorney, Agent, or Firm*—Edward D. Manzo; Mark J. Murphy; Ted K. Ringsred

[57] ABSTRACT

An article of sport footwear with a shell formed with two, respectively forward and rearward, longitudinally opposite openings which extend from a shell entrance and identify two lateral sides, with a bootleg pivoted on the shell and at least one fastening device bridging the corresponding opening and being adjustable in length, whose opposite ends are anchored on respective lateral sides of the shell proximate to the entrance to limit the rearward swing range of the bootleg and/or the forward flex of the boot.

11 Claims, 3 Drawing Sheets

SPORT BOOT WITH A FASTENING DEVICE TO LIMIT REARWARD SWING OR FORWARD FLEX

BACKGROUND OF THE INVENTION

This is a continuation of application Ser. No. 08/303,988 filed on Sep. 9, 1994, now abandoned.

This invention relates to an article of sport footwear, in particular to a ski boot, a skating boot, or the like, having a shell with a main longitudinal spread and formed with two longitudinally opposite, respectively forward and rearward, openings being so located on said shell as to respectively allow the skier's leg to lean forwards and rearwards, said openings extending from a shell entrance and defining two transversely opposite lateral sides on said shell, a bootleg pivoted on the shell and embracing said lateral sides at least partway, and a means on the shell of limiting the allowable bootleg rearward swing and/or limiting the allowable boot forward flex.

The bootlegs of ski boots of the above kind are usually arranged to return, from a normal skiing position where the skier's leg is imposed a slight forward bend, to a rest position which allows for increased stretching, and hence enhanced relaxation, of the leg muscles. The ability to switch to this position is specially appreciated while walking or during rest breaks. Also known is that such boots are provided with a means of adjusting the allowable forward flex of the leg, i.e. toward the toe of the boot, from the above-mentioned skiing position.

A boot type which incorporates both features is known, for example, from European Patent Application N° 93201691.8 by this Applicant.

That document discloses a boot having a bootleg which is pivoted by means of pins to the shell and secured to the shell through a knob affording three position settings, namely: a setting where the bootleg is locked relative to the shell for the skiing position, a setting where a rearward swing is allowed from the skiing position toward a rest position, and a setting where a forward swing is allowed from the skiing position toward a more forward-leaning position.

While that boot is technically satisfactory, and its adjustable feature beneficial, it still has a drawback in that it affords no freedom of adjustment for the stop positions to the forward or rearward swings of the bootleg, except as allowed for by the knob control. In addition, due to the relative proximity of the elements attaching the shell to the bootleg and providing such limitations and the pins whereby the bootleg is pivotably connected to the shell, a comparatively large stress is imposed on such attachment elements and the shell, for a given resisting torque provided to limit said swing movements.

Also, the imposable limitations, but for the locked shell/bootleg position, are only applied to one of the two (forward flex/rearward flex) possible movements, which restricts the range of adjustment for such movements.

The underlying technical problem of this invention is to provide an article of sport footwear, such as a ski boot, whose construction and performance are effective to obviate the drawbacks with which the cited prior art is beset.

SUMMARY OF THE INVENTION

This problem is solved by the invention through an article of sport footwear of the kind outlined in the introduction and characterized in that said means comprises at least one fastening device which extends between said lateral sides of the shell to bridge the corresponding opening, said fastening device comprising respective fastening elements attached to the corresponding lateral sides at a location close to said entrance and coupled adjustably together.

BRIEF DESCRIPTION OF THE DRAWINGS

The invention will now be described with reference to two preferred embodiments thereof illustrated, by way of example and not of limitation, by the accompanying drawings, in which.

DESCRIPTION OF THE PREFERRED EMBODIMENTS

Figure 5:
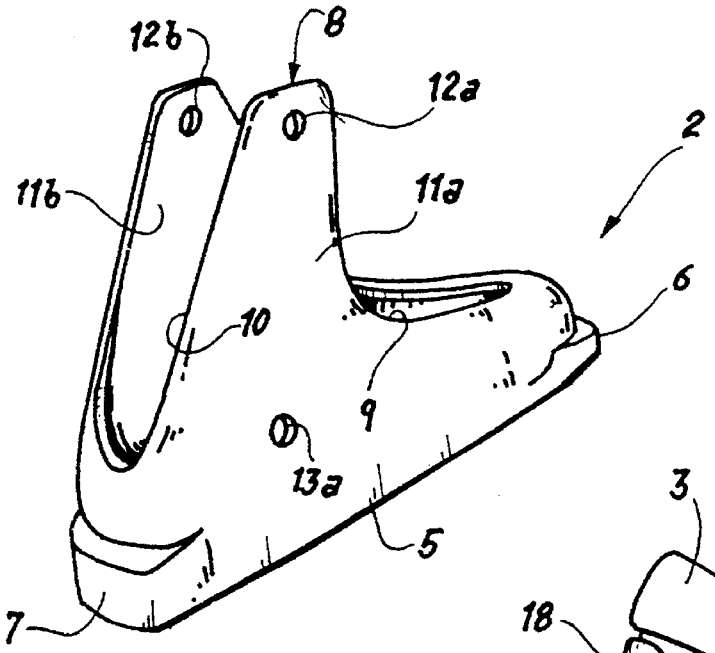
FIG. 5 is a perspective view of the shell of the boot shown in the preceding figures.

In the drawing figures, generally shown at 1 is a ski boot including a shell 2, an inner shoe 3, and a bootleg 4. The shell and bootleg are preferably plastics mouldings.

The shell 2 (FIG. 5) has a sole 5 with oppositely located toe 6 and heel 7 ends which identify a longitudinal direction of the boot. Defined on the remote end from the sole 5, at the free end of the shell portion which encircles the skier's leg, is an entrance 8 whence two, respectively forward and rearward, openings 9, 10 extend. Such openings 9, 10, which in the example illustrated carry no flaps, although it should be understood that one or both of them may be of the overlapping flap type, serve the function of allowing a comparatively wide swing range for the inner shoe 3 and a tongue 3*a* associated with it in the longitudinal direction of the boot. Thus, they may be replaced within the scope of this invention with another means providing that swing range. In view of the supporting function served by the tongue and the inner shoe when the boot is flexed forwards, these are also referred to as forward boot supports in the claims.

Said openings 9, 10 define two lateral sides 11*a,b* on the shell; notice that such lateral sides span a considerable distance from the sole 5 for reasons to be explained.

The ends of the lateral sides 11*a,b* next to the entrance 8 are provided with respective holes 12*a,b*; holes 13*a,b* are correspondingly provided through the shell proximate to the sole 5 for the bootleg 4 articulation. This articulation is obtained using conventional means, such as rivets 13.

For closing and clamping the shell onto the user's foot, a lever fastening arrangement 14, known per se, is provided which acts on a cover 15 extending over the opening 9 on the back of the shell 2.

The bootleg 4 is preferably of the overlapping flap type having two fastening arrangements 16, 17, also conventional, whereby it can be clamped in an adjustable manner onto the shell and the inner shoe to gird the skier's leg with a desired tension force. Said bootleg 4 has a lug 18 rearwardly, also called "spoiler", which provides hind support for the calf region of the skier's leg. Formed outwardly on said lug 18 is a seat 19 which extends circumferentially at the same level as the entrance 8. Notice that the top portions of the two lateral sides 11*a,b* project beyond the bootleg 4 on both sides of the lug 18.

On the top portion of the lateral side 11*a*, there is secured, as by means of a rivet or a stud 20 engaged in the hole 12*a*, the middle portion of a band-like flexible element 21 having, attached to its opposite end regions 21*a,b*, a pull-apart closure 22 of the kind known as "VELCRO", a registered trademark. The application of that closure is such that both end regions of the element 21 can be closed on each other in an adjustable manner.

In a similar way to the lateral side 11*a*, to the middle of the top portion of the lateral side 11*b* there is attached, as by means of a rivet or stud 23 engaged in the hole 12*b*, a second band-like element 24 whose ends 24*a,b* carry a ring 25 through which the corresponding end portion 21*a,b* of the elements 21 is engaged in a releasable manner. The lateral sides 11*a*, 11*b* are substantially rigid in the longitudinal direction so as to resist a pull applied thereto by the fastening devices.

Thus, the corresponding end portions 21*a*, 24*a* and 21*b*, 24*b*, respectively, constitute fastening elements of respective band-like fastening devices which are tightened in a releasable and adjustable manner by means of their respective rings 25 and pull-apart closures to provide the following functions.

Figure 1:
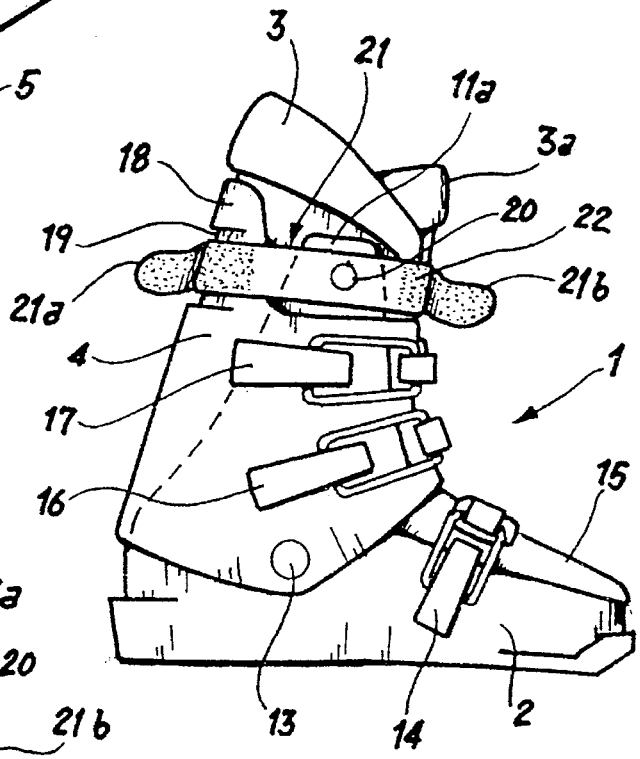
FIG. 1 is a side elevation view of a ski boot according to the invention as set for a skiing position.
Figure 2:
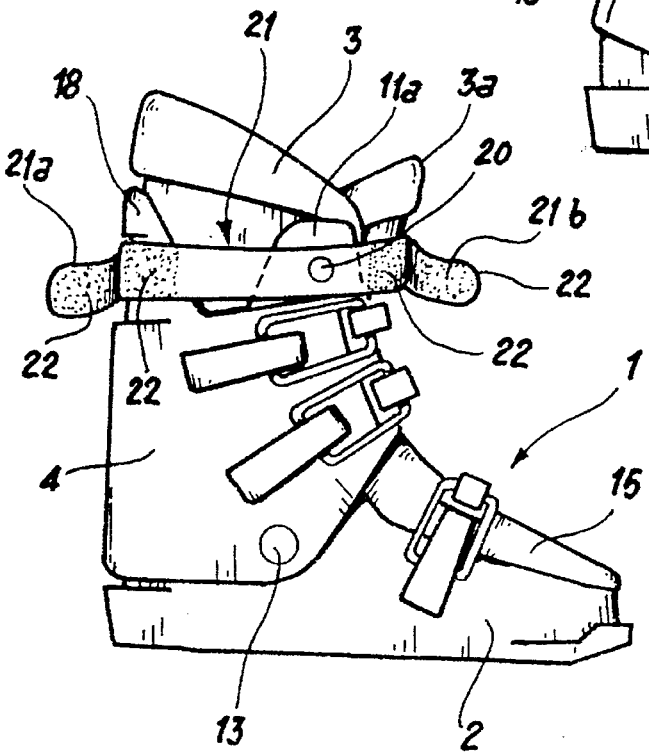
FIG. 2 is a side elevation view of the same boot in the rest position thereof.
Figure 3:
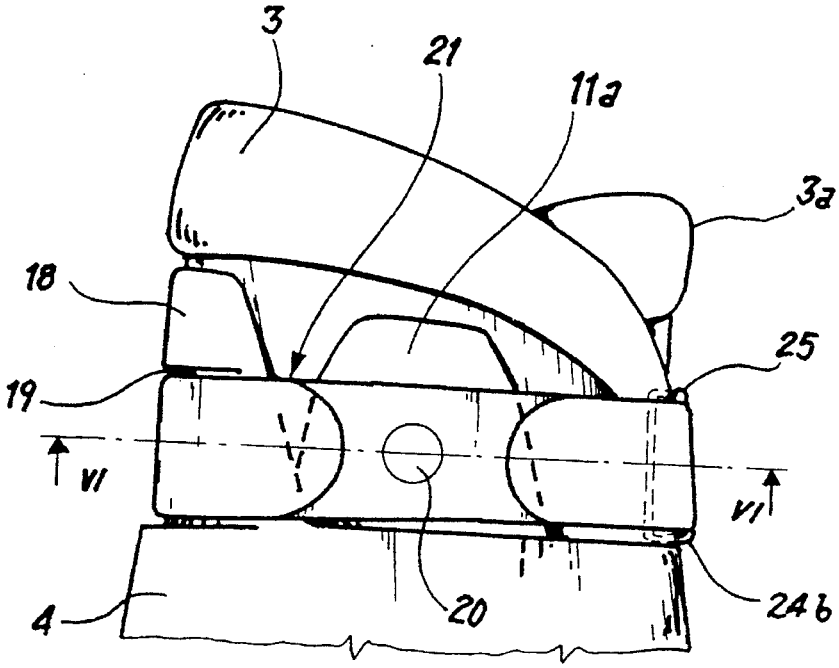
FIGS. 3 and 4 are enlarged detail elevation views of the boot in FIG. 1, respectively as viewed from one side and the rear.
Figure 4:
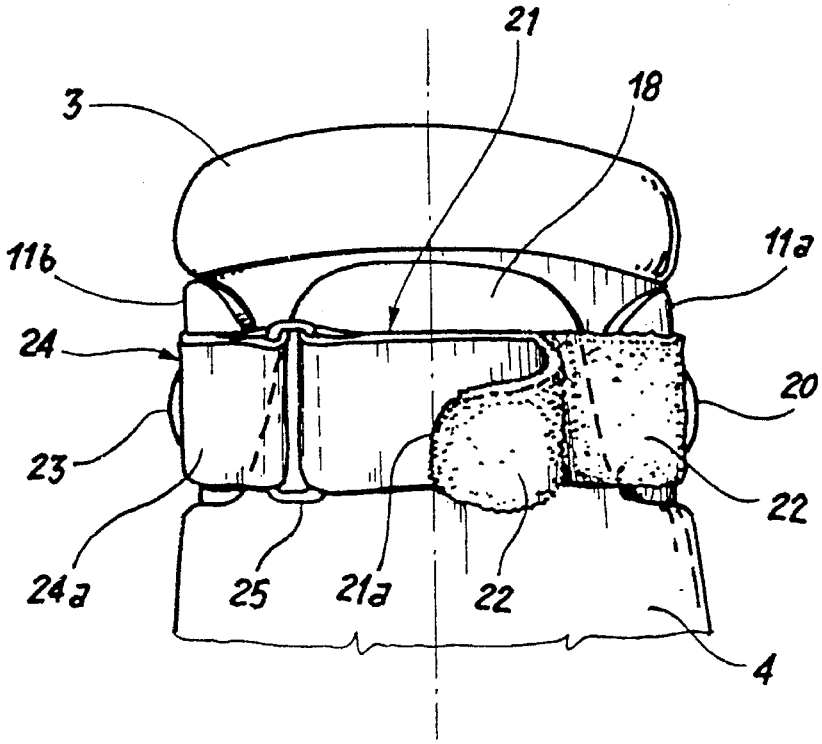

As for the band-like fastening device composed of the elements 21*a*, 24*a*, it is led along the seat 19 on the lug 18 such that it will bridge the opening 10 and function to limit the rearward swing of the bootleg 4 and the inner shoe 3. In essence, by lengthening the adjustment of that fastening device from the skiing position of FIG. 1 (or, in the extreme, by fully releasing the pull-apart closure), the bootleg is caused to straighten up toward the rest position of FIG. 2. Said device 21*a*, 24*a*, therefore, controls the free rearward swing of the bootleg and the inner shoe, which swing is, as previously mentioned, allowed for by the opening 10. Conversely, by shortening the adjustment of the fastening device 21*a*, 24*a*, the forward inclination of the bootleg 4 can be increased.

As for the band-like fastening device composed of the end elements 21*b*, 24*b*, it is led across the inner shoe 3 and the tongue 3*a* to bridge the forward opening 9, and functions to limit the forward flex of the boot 1. In essence, the shorter is the setting of the fastening device 21*b*, 24*b*, the stiffer becomes the boot, because the band-like device in question becomes a forward support for the skier's leg and is attached to the shell by means of the studs 20, 23. By converse, the longer is the setting of the device 21*b*, 24*b*, the more flexible becomes the boot in the forward direction.

Notice that both these adjustments are quite independent of the bootleg clamp-action adjustment performed by means of the lever fasteners 16, 17. Also notice that the tension transferred to the fastening devices 21*a*, 24*a* and 21*b*, 24*b* affords, by virtue of the considerable length of the lever arm from the pivot axis of the bootleg on the shell, the application of large resisting torques to the skier's leg. Additionally, all the stresses are transferred directly to the shell through the studs 20, 23.

Figure 7:
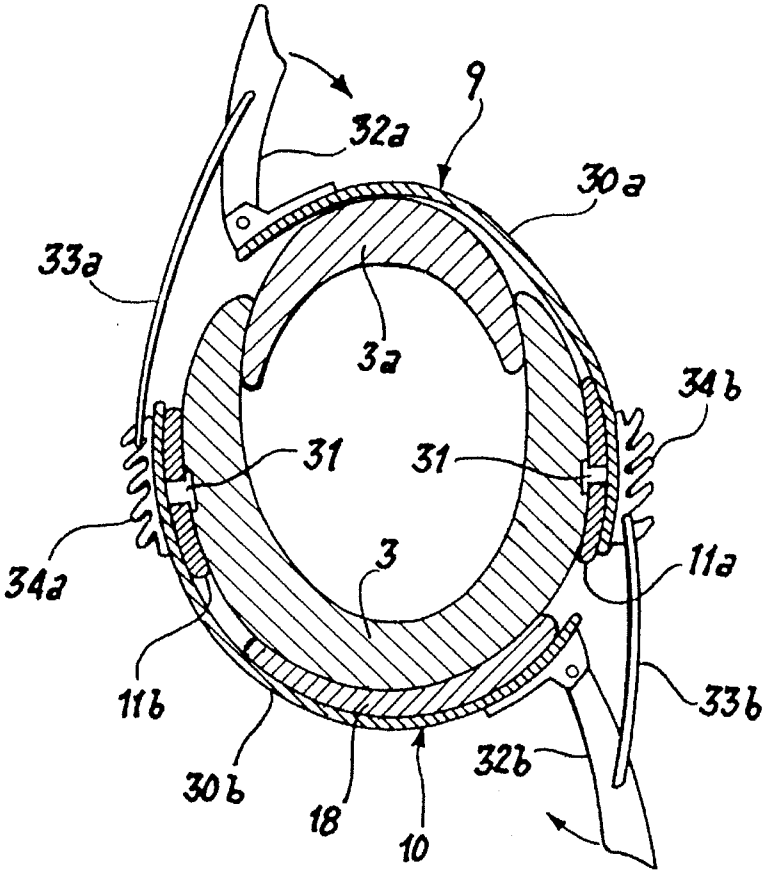
FIG. 7 is a sectional view corresponding to FIG. 6, showing a modified embodiment of the invention.
Figure 6:
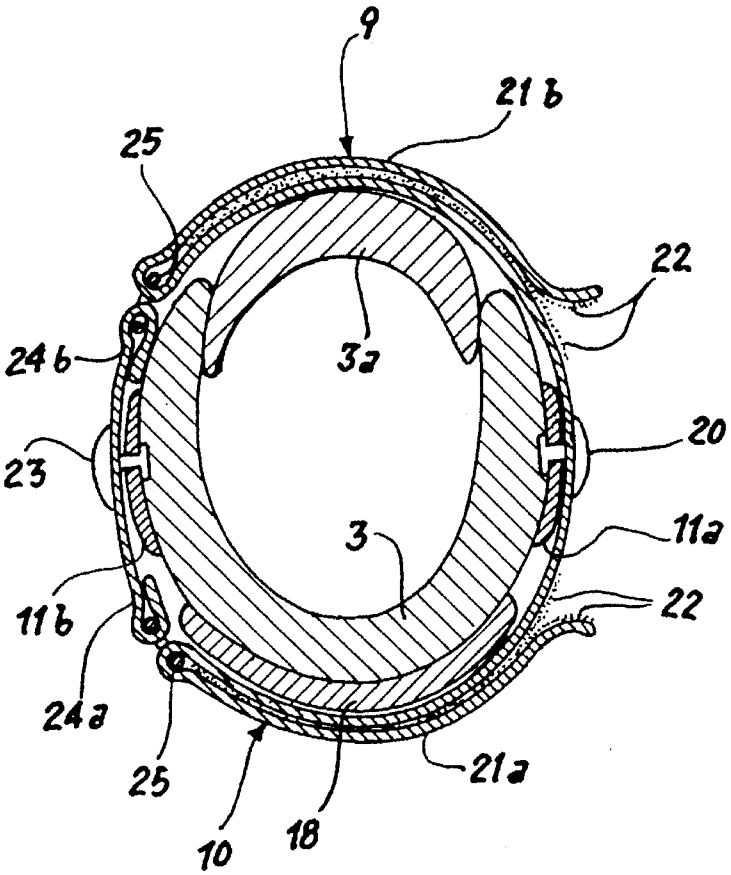
FIG. 6 is a sectional view taken along line VI—VI in FIG. 3.

In a modified embodiment shown in FIG. 7, where similar parts are denoted by the same reference numerals as in the previous embodiment, the two fastening devices located at the forward opening 9 and the rearward opening 10, respectively, are each comprised of a band-like flexible element 30*a,b*, one end whereof is attached, as by means of a rivet 31, to a corresponding lateral side 11*a,b* of the shell 2, the opposite end carrying a conventional lever fastener 32*a,b* whose ring 33*a,b* is engageable in an adjustable and releasable manner between teeth of a rack 34*a,b* which is attached to the opposite lateral side 11*b* and 11*a*, respectively, by means of the rivet 31 itself. It will be understood that the fastening devices in question may be any suitable arrangement known in the ski boot art.

Thus, the invention does solve the problem proposed with an advantageously simple, economical and versatile structure.

I claim:

1. An article of sport footwear having a shell with a main longitudinal spread and formed with two longitudinally opposite, respectively forward and rearward, openings being so located on said shell as to respectively allow a leg of a user to lean forwards and rearwards, said openings extending from a shell entrance and defining two transversely opposite lateral sides on said shell, a bootleg pivoted on the shell and embracing said lateral sides at least partway, a means on the shell for limiting the pivoting bootleg rearward swing, characterized in that said means comprises at least one fastening device which extends between said lateral sides of the shell to bridge the rear opening, said fastening device comprising respective fastening elements attached to the corresponding lateral sides at a location close to said entrance and coupled adjustably together, said bootleg having a continuously closed rear portion bridging the rear opening, the fastening device extending over said continuous portion in order to adjustably limit the ability of the bootleg to swing backward, and said lateral sides being substantially rigid in the longitudinal direction so as to resist a pull applied thereto by the fastening device, and a fastening arrangement provided on said bootleg for closing the boot, said fastening arrangement being independent of said at least one fastening device.

2. An article of footwear according to claim 1, wherein said fastening device extends through the rearward opening and is so attached to the bootleg as to limit the rearward swing of said bootleg relative to the shell.

3. An article of footwear according to either claim 1 or 2, wherein said fastening device extends through the forward opening and acts on a forward support of the boot to limit the forward flex of said support and said bootleg relative to the shell.

4. An article of footwear according to claim 3, wherein corresponding fastening elements of said fastening devices respectively provided on the forward and the rearward openings of the shell are secured at common locations on a respective one of the lateral sides.

5. An article of footwear according to claims 1, 2, or 4, further comprising fastening arrangements provided on said shell for closing the boot, said fastening arrangements on said shell being independent of said at least one fastening device and said fastening arrangements on said bootleg.

6. An article of footwear according to claims 1, 2, or 4, wherein the lateral sides of the shell extend above said bootleg such that they will project beyond it on the side of said entrance to said footwear by said user.

7. An article of footwear according to claim 6, wherein said elements of the fastening devices are anchored on the respective lateral sides of said shell wherein said lateral sides project beyond said bootleg.

8. An article of footwear according to claims 1, 2, or 4, wherein said fastening devices are a pull-apart type.

9. An article of footwear according to claims 1, 2, or 4, wherein the bootleg has a lug providing hind support for the leg of the user, the corresponding fastening device extending around the bootleg at said lug.

10. An article of footwear according to claims 1, 2, or 4 wherein said fastening devices comprise a first band-like flexible element attached at the middle to one corresponding lateral side and carrying on its opposite ends complemental fastening means, whereby both ends of said band-like element can be closed on each other, and a second band-like element attached at the middle to the other corresponding lateral side and carrying on its opposite ends a respective ring wherethrough the corresponding end of the first band-like element is passed.

11. An article of sport footwear having a shell with a main longitudinal spread and formed with two longitudinally opposite, respectively forward and rearward, openings being so located on said shell as to respectively allow a leg of a user to lean forwards and rearwards, said openings extending from a shell entrance and defining two transversely opposite lateral sides on said shell, a bootleg pivoted on the shell and embracing said lateral sides at least partway, and a means on the shell for limiting the pivoting bootleg rearward swing, characterized in that said means comprises at least one fastening device which extends between said lateral sides of the shell to bridge the rear opening, said fastening device comprising respective fastening elements attached to the corresponding lateral sides at a location close to said entrance and coupled adjustably together, said bootleg having a continuously closed rear portion bridging the rear opening, the fastening device extending over said continuous portion in order to adjustably limit the ability of the bootleg to swing backward, and said lateral sides being substantially rigid in the longitudinal direction so as to resist a pull applied thereto by the fastening device said fastening devices comprise a first band-like flexible element attached at the middle to one corresponding lateral side and carrying on its opposite ends complemental fastening means, wherein both ends of said band-like element can be closed on each other, and a second band-like element attached at the middle to the other corresponding lateral side and carrying on its opposite ends a respective ring wherethrough the corresponding end of the first band-like element is passed.

* * * * *